US008925458B2

(12) United States Patent
Moore et al.

(10) Patent No.: US 8,925,458 B2
(45) Date of Patent: Jan. 6, 2015

(54) CLEANING STRUCTURE AND METHOD FOR FRICTION ROLL FEEDERS

(75) Inventors: Kenneth P. Moore, Rochester, NY (US); Frank A. Porter, Penfield, NY (US); Ron E. Dufort, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 584 days.

(21) Appl. No.: 13/308,755

(22) Filed: Dec. 1, 2011

(65) Prior Publication Data

US 2013/0139847 A1 Jun. 6, 2013

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS

| | | | | |
|---|---|---|---|---|
| 4,020,499 A | | 4/1977 | Vroom | |
| 5,138,390 A | * | 8/1992 | Miyabayashi et al. | 399/111 |
| 5,153,964 A | * | 10/1992 | Gelardi et al. | 15/229.12 |
| 5,896,157 A | * | 4/1999 | Fisher, Sr. | 347/171 |
| 6,030,674 A | * | 2/2000 | Onishi et al. | 428/40.1 |
| 6,032,004 A | | 2/2000 | Mirabella, Jr. et al. | |
| 6,090,463 A | * | 7/2000 | Sakaki et al. | 428/42.1 |
| 6,277,457 B1 | * | 8/2001 | Onishi et al. | 428/40.1 |
| 7,421,237 B2 | | 9/2008 | Funato et al. | |
| 7,729,653 B2 | * | 6/2010 | Kawamoto et al. | 399/343 |
| 2001/0011795 A1 | * | 8/2001 | Ohtsuka et al. | 271/145 |
| 2002/0185804 A1 | | 12/2002 | Wood et al. | |

FOREIGN PATENT DOCUMENTS

| | | | |
|---|---|---|---|
| JP | 05201590 A | * | 8/1993 |
| JP | 10081003 | | 3/1998 |
| JP | 2008272640 | | 11/2008 |

* cited by examiner

*Primary Examiner* — Anthony Nguyen
(74) *Attorney, Agent, or Firm* — Gibb & Riley, LLC

(57) ABSTRACT

With a cleaning system/method, a user places a printing device in a cleaning mode, inserts a cleaning apparatus that includes a cleaning sheet into a paper supply tray of the printing device, and executes a cleaning operation on the printing device. With the system, a set of instructions is stored on a machine-readable medium. The set of instructions causes the printing device to execute a cleaning operation on a feed nip of the printing device. The cleaning sheet cleans the feed roller and the retard roller when it is positioned within the feed nip during the cleaning operation. The set of instructions cause the printing device to move the cleaning sheet into the feed nip and to rotate the feed roller and the retard roller for a predetermined time period, when the printing device is placed into a cleaning mode.

15 Claims, 6 Drawing Sheets

CLEANING STRUCTURE AND METHOD FOR FRICTION ROLL FEEDERS

BACKGROUND

Embodiments herein generally relate to a cleaning system and method for friction rollers and more particularly to situations where the user places a printing device in a cleaning mode, inserts a cleaning apparatus into a paper supply tray of the printing device, and executes a cleaning operation on the printing device.

Friction retard feeders (FRF) have feed, retard, and nudger roll materials designed for maximum roll life, which reduces the need for customer or customer service engineer (CSE) roll replacement. As a result, the slow rate of wear of the rolls results in gradual contamination of the rolls from paper dust and debris. This, in turn, causes degradation in the roll coefficient of friction (COF) resulting in increased misfeed rates. This is especially true for the nudger roll, which advances the top sheet(s) into a feed nip, and the feed roll itself, which drives the top sheet through the retard nip. The countermeasure for this is to clean or replace the appropriate rolls. Customers are very resistant to take the time to do this since the machines using the FRF technology are typically walk-up machines with untrained and/or disinterested operators.

Since cleaning or replacing the nudger or feed rolls takes training and time and some rolls are not even accessible to the operator, a better method for roll cleaning that takes little or no training and time to maintain COF and reduce the misfeed shut down rate (SDR) would be useful.

SUMMARY

An exemplary cleaning system and method is provided herein. With this system/method, the user places a printing device in a cleaning mode, inserts a cleaning apparatus into a paper supply tray of the printing device, and executes a cleaning operation on the printing device. With the system, a set of instructions is stored on a machine-readable medium. The set of instructions causes the printing device to execute a cleaning operation on a feed nip of the printing device.

The cleaning apparatus includes a first sheet of material (sized to be held in a fixed position between paper guides of a paper supply tray of a printing device), a cleaning sheet that is connected to the first sheet, and at least one connector connecting the first sheet to the cleaning sheet. The first sheet can have a unique size/shape, or can have a size and shape that matches a standard paper size. For example, the first sheet can have a size and shape that matches an 8½×11 paper size, 8½×14 paper size, 8×10 paper size, 5×7 paper size A-4 paper size, A-5 paper size, B-4 paper size, etc.

The connector has a rod and the cleaning sheet has a slot through which the rod extends. The slot allows the cleaning sheet to move relative to the first sheet. Some cleaning apparatuses can also include a biasing member connected to the first sheet and the cleaning sheet. The biasing member biases the cleaning sheet away from the feed nip.

The cleaning sheet has a size and thickness to fit into the feed nip (formed between a feed roller and a retard roller) during the cleaning operation. The cleaning sheet also has an abrasive surface sufficient to clean the feed roller and the retard roller. The connector allows the cleaning sheet to move a certain distance (relative to the first sheet) to allow the cleaning sheet to move into the feed nip, when the first sheet is held in the fixed position in the paper supply tray during the cleaning operation. The cleaning sheet cleans the feed roller, nudger roller, and retard roller when it is positioned within the feed nip during the cleaning operation. The set of instructions cause the printing device to move the cleaning sheet into the feed nip and to rotate the feed roller and the retard roller for a predetermined time period, when the printing device is placed into a cleaning mode.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
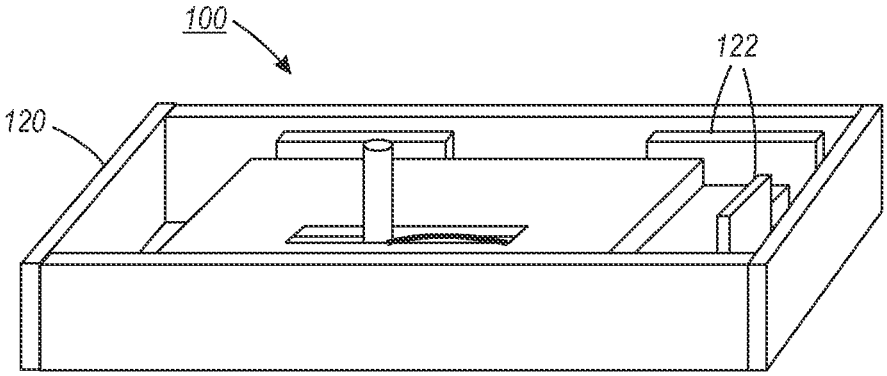
FIG. 1 is a perspective-view schematic diagram of a device according to embodiments herein.

As mentioned above, cleaning or replacing the nudger or feed rolls takes training and time and some rolls are not even accessible to the operator. In view of this, devices and methods herein perform cleaning operations that take little training and time. More specifically, as shown in perspective view in FIGS. 1-3 and 8, and in cross-sectional view in FIGS. 4-7, the apparatuses 100 presented herein utilize a plate 102 (such as a rigid sheet or flat structure, which is sometimes referred to herein as a "first sheet" or "base plate") which supports a replaceable stack of (or individual) abrasive sheet(s). The abrasive sheets are sometimes referred to herein as "cleaning sheets" and are identified by reference number 104 in the drawings. The cleaning sheets align with and clean the nudger 124 and feed rolls 126.

Figure 4:
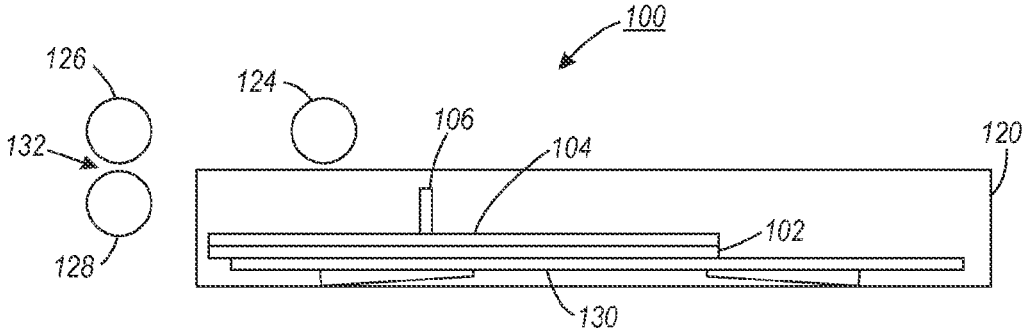
FIG. 4 is a side-view schematic diagram of a device according to embodiments herein.
Figure 7:
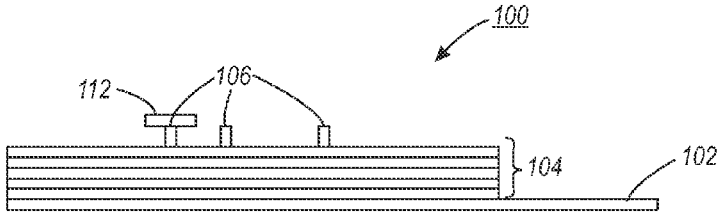
FIG. 7 is a side-view schematic diagram of a device according to embodiments herein.

As shown in FIGS. 1 and 4, the apparatus 100 is loaded into the paper supply tray 120 just as paper would be, and positioned using the existing side and trail edge guides 122. As shown, for example in FIG. 8 instructions 114 are provided for use and for obtaining replacement cleaning sheets 104. For example, such instructions 114 for reordering the cleaning sheets 104 and for using the cleaning apparatus 100 can be included on the base plate 102 or some other convenient location. In the example shown in FIG. 8, the instructions 114 are included on an extended portion of the plate 102, which is distinct from the area 140 where the stack of cleaning sheets 104 will be positioned on the plate 102 (such a stack is shown in FIG. 7). As alternatively shown in FIG. 8, extra cleaning sheets 104 can be clipped to the base plate 102 allowing such spare cleaning sheets 104 to be self-contained within the cleaning apparatus 100.

The cleaning apparatus 100 includes the base plate 102 of material (sized to be held in a fixed position between paper guides 122 of a paper supply tray 120 of a printing device). The base plate 102 can comprise any appropriate material, such as plastics, metals, alloys, etc., and generally has a thickness and rigidity sufficient to be firmly held in alignment by the various paper guides 122.

The base plate 102 can have any size or shape to allow it to be held securely in the paper tray 120. Thus, the base plate 102 could be rectangular, rounded, etc. For example, the base plate 102 can have a size and shape that matches a standard paper size. For example, the base plate 102 can have a size and shape that matches an 8½×11 paper size, 8½×14 paper size, 8×10 paper size, 5×7 paper size A-4 paper size, A-5 paper size, B-4 paper size, etc. Alternatively, the base plate 102 can have a unique size that can be read by the length and trailing edge guides of the printing device to automatically indicate to the printing machine that a cleaning operation should be initiated.

Figure 8:
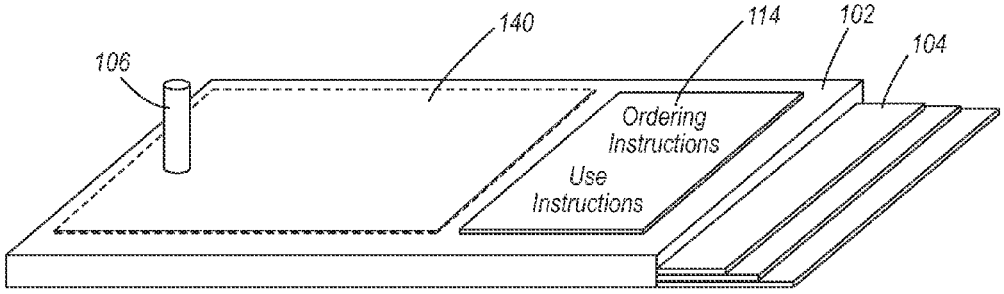
FIG. 8 is a perspective-view schematic diagram of a device according to embodiments herein.

At least one cleaning sheet 104 (which is sometimes referred herein as an abrasive sheet) is connected to the base plate 102 by at least one connector 106 (which is sometimes referred to herein as a connecting rod or retaining pin). The cleaning sheet 104 is free to move along the surface of the base plate 102; however, is held in alignment by the connector 106. The connector comprises at least one connecting rod 106 that is firmly attached to the base plate 102 (as shown in FIG. 8). Each cleaning sheet 104 comprises a slot 110 through which the rod extends. The rod 106 can be as simple as a rectangular or rounded post, or the connecting rod 106 can include a textured surface (as shown in FIG. 8), a cap 112, etc., depending upon each specific implementation. Therefore, as shown in FIG. 7, multiple connector rods 106 can be utilized and one or more of the connector rods 106 can include a cap 112. The slot 110 limits the movement of the cleaning sheet 104 in a processing direction (relative to the first sheet 102). In other words, the cleaning sheet 104 can only move as far as the combined action of the slot 110 and connecting rod 106 will allow.

Some cleaning apparatuses 100 can also include a biasing member 108 connected to the first sheet 102 and the cleaning sheet 104. The biasing member 108 can comprise any structure that may exert force in one or more directions including, a spring, a flexible strip, an actuator, a piston, etc. The biasing member 108 biases the cleaning sheet 104 away from the feed nip 132 to allow the cleaning sheet 104 to return to a centered position above the base plate 102 after the cleaning operation is complete.

The cleaning sheet 104 has a size and thickness to fit into a feed nip 132 formed between the feed roller 126 and the retard roller 128 during the cleaning operation. The cleaning sheet 104 also has an abrasive surface sufficient to clean the nudger roller 124, the feed roller 126, and the retard roller 128. For example, the cleaning sheet 104 can comprise paper, plastic, fiberglass, metal, alloys, etc., which have a textured surface. Thus, the cleaning sheet 104 can be formed with grooves or ridges, or formed of a woven material, to have a textured surface. Alternatively, the cleaning sheet 104 may include abrasive particles such as brush fibers, sand grains, silicon grains, pumice grains, etc., that have been attached to the surface of the cleaning sheet 104. The cleaning sheet 104 can comprise a dry or a wet cleaning sheet. Thus, the cleaning sheet 104 can be dampened with a liquid cleaning solution that in combination with the abrasive surface of the cleaning sheet (or alone) cleans the surfaces of the rollers it contacts.

The connector 106 allows the cleaning sheet 104 to move a certain distance (relative to the first sheet 102) to allow the cleaning sheet 104 to move into the feed nip 132, when the first sheet 102 is held in a fixed position in the paper supply tray 120 during the cleaning operation. The cleaning sheet 104 cleans the nudger roller 124, the feed roller 126, and the retard roller 128 when it is positioned within the feed nip 132 during the cleaning operation.

Figure 5:
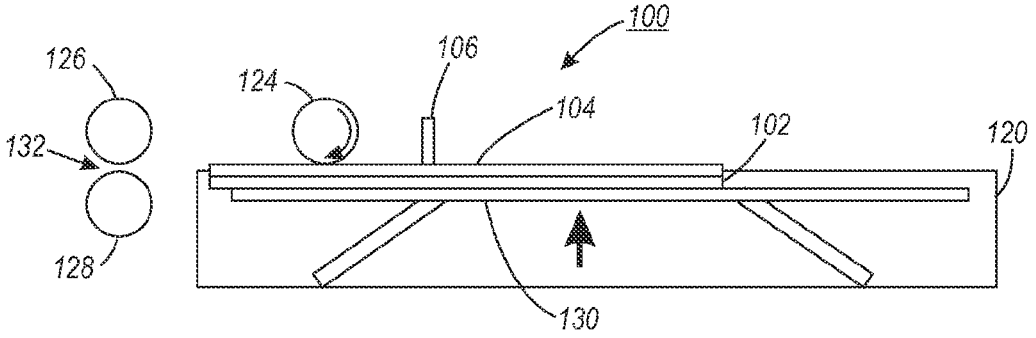
FIG. 5 is a side-view schematic diagram of a device according to embodiments herein.

When the operator or CSE wishes to clean the rolls for a particular feeder, the cleaning apparatus 100 is loaded into the paper supply tray 120, as paper would be, and is positioned using the existing side and trail edge guides 122, as shown in FIGS. 1 and 4. As shown, the abrasive sheet 104 is loaded in a "retracted" position centered over the base plate 102, without overlapping the lead edge of the tray 120. When the paper tray 120 is closed, the lift plate 130 raises the base plate 102 placing the abrasive sheet 104 into contact with the nudger 124 roll, as shown in FIG. 5.

The operator then selects a "cleaning operation" on the user interface of the printing device. Alternately, a unique size for the base plate 102 could be read by the length and trailing edge guide sensors of the printing device to automatically indicate to the printing machine that a cleaning operation should be initiated. The unique size of the base plate 102 can also be used to prevent any remote incoming jobs from using the feeder that is being cleaned before the completion of the "cleaning operation."

Figure 2:
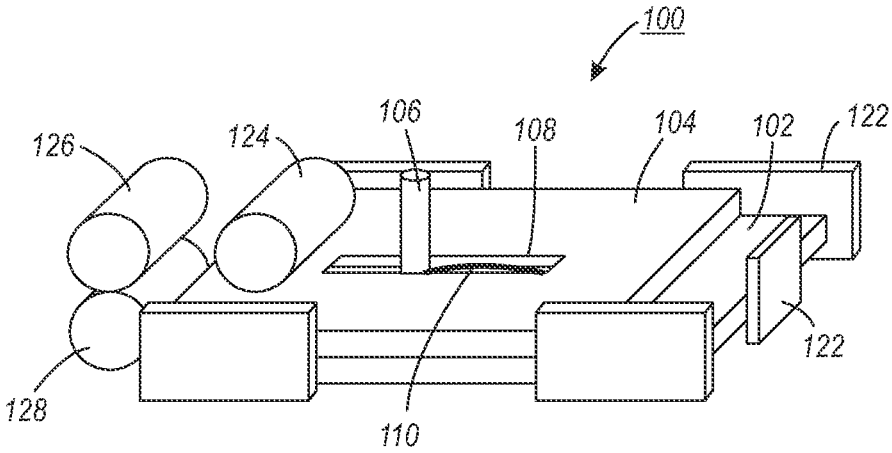
FIG. 2 is a perspective-view schematic diagram of a device according to embodiments herein.
Figure 3:
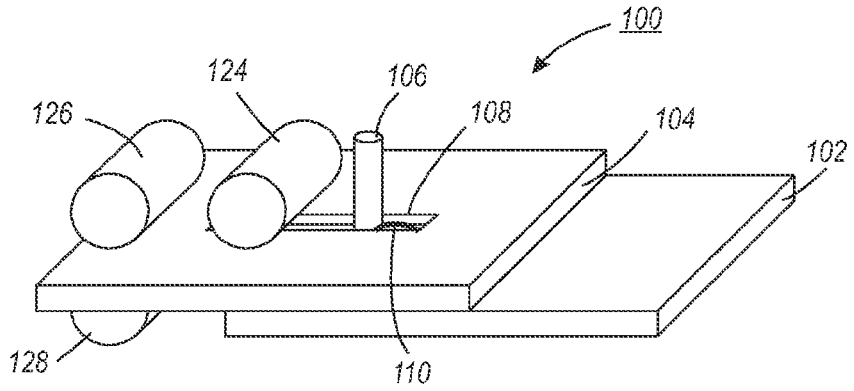
FIG. 3 is a perspective-view schematic diagram of a device according to embodiments herein.
Figure 6:
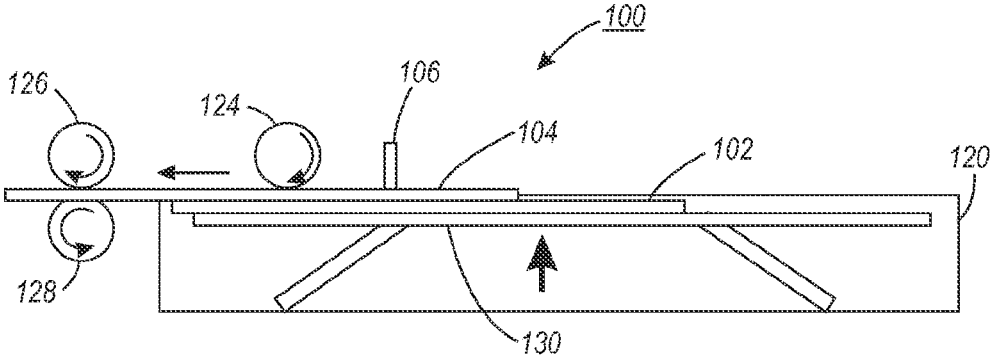
FIG. 6 is a side-view schematic diagram of a device according to embodiments herein.

In any case, once the cleaning operations has been initiated, the nudger 124 roll then drives the cleaning sheet 104 a short distance into the feed/retard nip 132. More specifically, FIG. 2 shows the nudger roller 124 just beginning to move the cleaning sheet 104 toward the feed and retard rollers 126, 128, and FIGS. 3 and 6 show the cleaning sheet 104 positioned in the feed nip 132 between the feed and retard rollers 126, 128. Note that the tray 120 is not shown in FIGS. 2 and 3 (and the guides 122 are not shown in FIG. 3) in order to allow the operations of the various elements of the cleaning apparatus 100 to be more easily seen.

Once the cleaning sheet 104 is in the position shown in FIGS. 3 and 6, both the nudger 124 roll and feed roll 126 (and potentially the retard roller 128) then attempt to drive the abrasive sheet 104 (as shown by the curved arrows in FIG. 6), but are unable to move the cleaning sheet 104 due to the retaining pin(s) 106 in the base plate 102 which limit the cleaning sheet 104 travel. This results in relative motion of the rolls with the abrasive sheet 104 and the resultant cleaning of the nudger 124 and feed rolls 126 (and potentially the retard roller 128) of contaminants.

The time period for this cleaning operation can vary for each different printing device (depending upon roller size, average contamination amounts, usage amounts, etc.) but usually only lasts for a few seconds. Upon completion of the cleaning operation, the tray 120 is opened, which immediately releases the abrasive sheet 104 from the feed/retard nip 132 and raises the nudger 124 roll. This allows the abrasive sheet 104 to be removed as the tray 120 is pulled open (and the biasing member 110 assists in this action).

Thus, the structures and methods herein provide a highly effective "dry" cleaning system to simultaneously clean nudger, feed, and retard rolls. This single system can be used for an entire machine, or even multiple machines at an account, as opposed to a dedicated, built-in roll cleaner for each feed head in a machine. This provides a low cost system that does not add to unscheduled maintenance costs, and is removable for easy maintenance. The structures and methods herein can be used with any friction retard feeder within any type of printing machine and can be adapted to either center or edge registered feeders. Further, these systems can be used by a customer service engineer, or an operator with minimum or no training. The structures and methods herein are very low cost and are easy to use, as the operating instructions and replacement abrasive sheets ordering instructions can be printed on the base plate.

Figure 9:
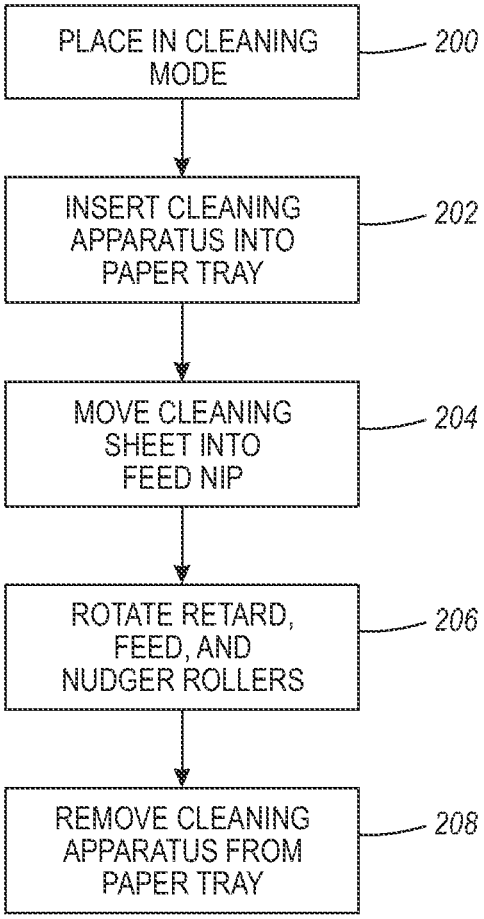
FIG. 9 is flow diagram illustrating various embodiments herein.

FIG. 9 is flowchart illustrating an exemplary method herein. In item 200, the user places the printing device in a cleaning mode. In item 202, the user inserts the cleaning apparatus into the paper supply tray of the printing device, and executes a cleaning operation on the printing device. Rather than having the user interact with the user interface to instruct the printing device to perform a cleaning operation, the unique size for the base plate could be automatically read by the length and trailing edge guides of the printing device to automatically indicate to the printing machine that a cleaning operation should be initiated. Therefore, items 200 and 202 could occur simultaneously.

Regardless of how the cleaning operation is initiated, with the system, a set of instructions is previously stored on the machine-readable medium of the printing device. The set of instructions causes the printing device to execute the cleaning operation on the feed rollers of the printing device. More specifically, the set of instructions cause the printing device to move the cleaning sheet into the feed nip (item 204) and to rotate the feed roller, the retard roller, and potentially the nudger roller for a predetermined time period (item 206). In item 208, the user removes the cleaning apparatus from the paper tray to complete the cleaning operation.

Figure 10:
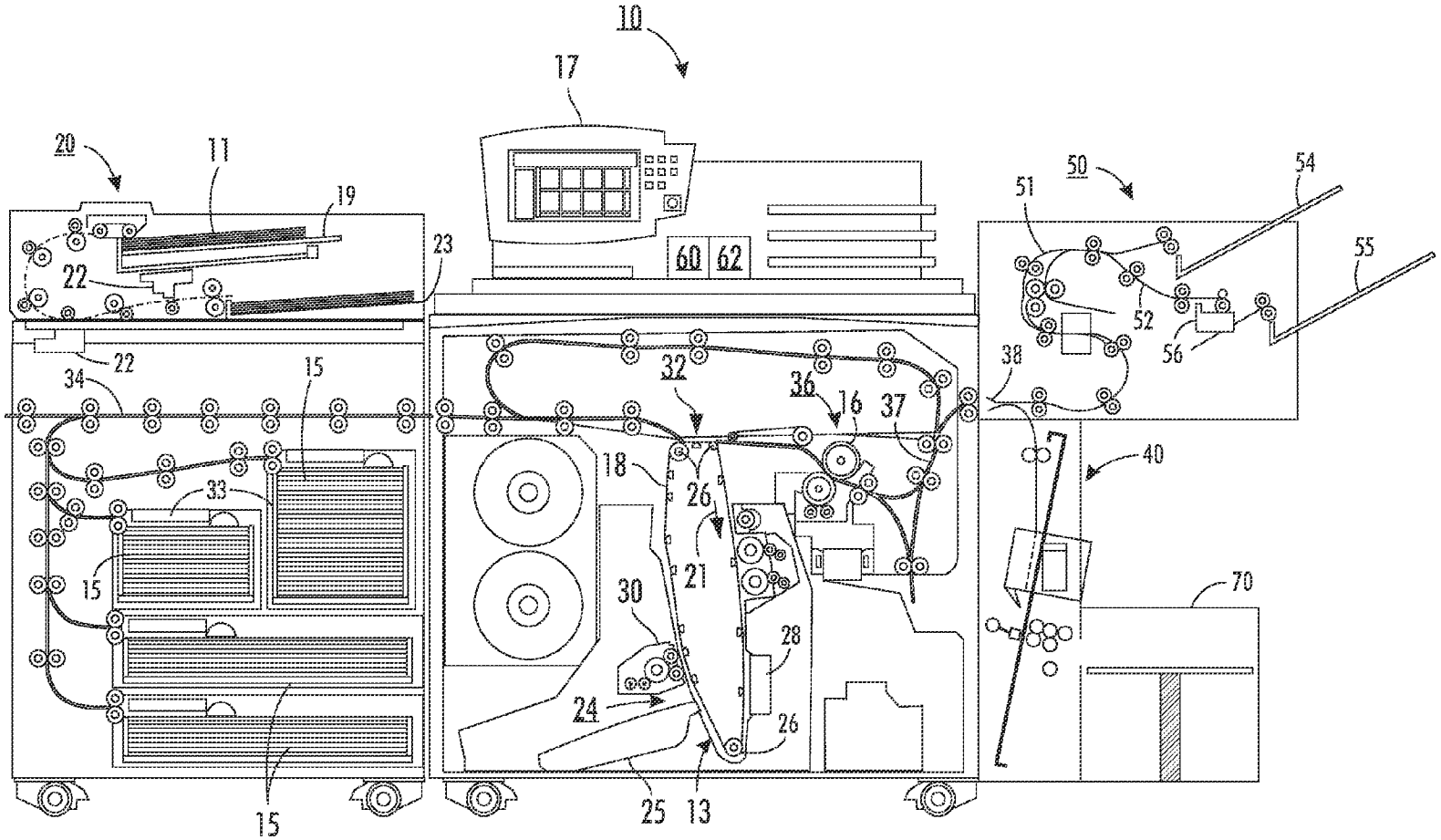
FIG. 10 is a side-view schematic diagram of a device according to embodiments herein.

FIG. 10 illustrates a printing machine 10 that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 of a photoreceptor belt 18 to form an electrostatic latent image. The photoreceptor belt 18 here is mounted on a set of rollers 26. At least one of the rollers 26 is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 10 is only one example and the embodiments herein are equally applicable to other types of printing devices that may include fewer components or more components. For example, while a limited number of printing engines and paper paths are illustrated in FIG. 10, those ordinarily skilled in the art would understand that many more paper paths and additional printing engines could be included within any printing device used with embodiments herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An apparatus comprising:

a first sheet of material sized to be held in a fixed position between paper guides of a paper supply tray of a printing device;

a cleaning sheet connected to said first sheet; and at least one connector connecting said first sheet to said cleaning sheet;

said cleaning sheet having a size and thickness to fit into a feed nip between a feed roller and a retard roller, said connector allowing said cleaning sheet to move a distance relative to said first sheet to allow said cleaning sheet to move into said feed nip when said first sheet is held in said fixed position in said paper supply tray, and said cleaning sheet cleaning said feed roller and said retard roller when said cleaning sheet is positioned within said feed nip.

2. The apparatus according to claim 1, said cleaning sheet having an abrasive surface sufficient to clean said feed roller and said retard roller.

3. The apparatus according to claim 1, said connector comprising a rod and said cleaning sheet comprising a slot through which said rod extends, said slot allowing said cleaning sheet to move relative to said first sheet.

4. The apparatus according to claim 1, said first sheet having a size and shape that matches a standard paper size.

5. The apparatus according to claim 1, said first sheet having a size and shape that matches one of an 8½×11 paper size, 8½×14 paper size, 8×10 paper size, 5×7 paper size A-4 paper size, A-5 paper size, B-4 paper size.

6. An apparatus comprising:

a first sheet of material sized to be held in a fixed position between paper guides of a paper supply tray of a printing device;

a cleaning sheet connected to said first sheet;

at least one connector connecting said first sheet to said cleaning sheet; and a biasing member connected to said first sheet and said cleaning sheet;

said cleaning sheet having a size and thickness to fit into a feed nip between a feed roller and a retard roller, said connector allowing said cleaning sheet to move a distance relative to said first sheet to allow said cleaning sheet to move into said feed nip when said first sheet is held in said fixed position in said paper supply tray, said biasing member biasing said cleaning sheet away from said feed nip, and said cleaning sheet cleaning said feed roller and said retard roller when said cleaning sheet is positioned within said feed nip.

7. The apparatus according to claim 6, said cleaning sheet having an abrasive surface sufficient to clean said feed roller and said retard roller.

8. The apparatus according to claim 6, said connector comprising a rod and said cleaning sheet comprising a slot through which said rod extends, said slot allowing said cleaning sheet to move relative to said first sheet.

9. The apparatus according to claim 6, said first sheet having a size and shape that matches a standard paper size.

10. The apparatus according to claim 6, said first sheet having a size and shape that matches one of an 8½×11 paper size, 8½×14 paper size, 8×10 paper size, 5×7 paper size A-4 paper size, A-5 paper size, B-4 paper size.

11. A cleaning system comprising:

a set of instructions stored on a machine-readable medium, said set of instructions causing a printing device to execute a cleaning operation on a feed nip of said printing device; and a cleaning apparatus comprising:

a first sheet of material sized to be held in a fixed position between paper guides of a paper supply tray of a printing device;

a cleaning sheet connected to said first sheet; and at least one connector connecting said first sheet to said cleaning sheet;

said cleaning sheet having a size and thickness to fit into a feed nip between a feed roller and a retard roller during said cleaning operation, said connector allowing said cleaning sheet to move a distance relative to said first sheet to allow said cleaning sheet to move into said feed nip when said first sheet is held in said fixed position in said paper supply tray during said cleaning operation, said cleaning sheet cleaning said feed roller and said retard roller when said cleaning sheet is positioned within said feed nip during said cleaning operation, and said set of instructions causing said printing device to move said cleaning sheet into said feed nip and to rotate said feed roller and said retard roller for a predetermined time period when said printing device is placed into a cleaning mode.

12. The cleaning system according to claim 11, said cleaning sheet having an abrasive surface sufficient to clean said feed roller and said retard roller.

13. The cleaning system according to claim 11, said connector comprising a rod and said cleaning sheet comprising a slot through which said rod extends, said slot allowing said cleaning sheet to move relative to said first sheet.

14. The cleaning system according to claim 11, said first sheet having a size and shape that matches a standard paper size.

15. The cleaning system according to claim 11, said first sheet having a size and shape that matches one of an 8½×11 paper size, 8½×14 paper size, 8×10 paper size, 5×7 paper size A-4 paper size, A-5 paper size, B-4 paper size.

* * * * *